United States Patent [19]

Meyers et al.

[11] 4,252,052

[45] Feb. 24, 1981

[54] PAPERBOARD POUCH FORMING METHOD AND APPARATUS

[75] Inventors: George L. Meyers, Ashland, Ohio; Peter T. Hunnicutt, Fond du Lac, Wis.; William R. Walker, Iola, Wis.; Douglas Schneider, Neenah, Wis.

[73] Assignee: American Can Company, Greenwich, Conn.

[21] Appl. No.: 20,516

[22] Filed: Mar. 14, 1979

[51] Int. Cl.[3] ..... B31B 3/26; B31B 3/60

[52] U.S. Cl. ..... 493/134; 493/167; 493/177

[58] Field of Search ..... 93/35 SB, 12 C, 12 R, 93/13, 51 M, 51 R, DIG. 1, 84 FF, 59 ES

[56] References Cited

U.S. PATENT DOCUMENTS

| | | | |
|---|---|---|---|
| 2,092,858 | 9/1937 | Richard | 93/35 SB |
| 2,568,382 | 9/1951 | Buckley et al. | 93/51 M |
| 3,114,298 | 12/1963 | Boone | 93/12 R |
| 3,140,643 | 7/1964 | Barthelmess | 93/12 R |
| 3,448,558 | 6/1969 | Hurtle | 53/141 |
| 3,593,623 | 7/1971 | Oakley | 93/51 R |
| 3,633,333 | 1/1972 | Schlemmer et al. | 53/182 |
| 3,785,255 | 1/1974 | Talbot et al. | 93/51 R X |
| 3,820,303 | 6/1974 | Martensson et al. | 53/186 |
| 3,953,272 | 4/1976 | Webber | 156/152 |
| 3,980,515 | 9/1976 | Reil et al. | 156/497 |
| 4,019,946 | 4/1977 | Greisman | 156/497 |

*Primary Examiner*—James F. Coan

*Attorney, Agent, or Firm*—Robert P. Auber; Ernestine C. Bartlett; Harry C. Engstrom

[57] ABSTRACT

Method and apparatus for forming a sealed pouch from a paperboard blank having a heat activatable sealing material on a surface thereof. Blanks are received in an initial position above opposed curved forming surfaces and underneath a reciprocating mandrel, with the blank being folded about the mandrel as the mandrel drives the blank in a longitudinal direction between the forming surfaces. Application of heated air activates the heat sealable material, and folding plates fold the longitudinal edges of the blank inwardly to a position where clamping bars can clamp the longitudinal edges together to complete the heat seal. The folding plates and clamping bars withdraw after the heat seal is completed, and the formed pouch is ejected from the mandrel which thereafter reciprocates to its initial position to allow another blank to be inserted above the forming surfaces.

17 Claims, 15 Drawing Figures

PAPERBOARD POUCH FORMING METHOD AND APPARATUS

BACKGROUND OF THE INVENTION

1. Field of the Invention

This invention pertains generally to the field of machines for forming cartons, and particularly to such apparatus suitable for forming sealed pouches capable of carrying food materials.

2. Description of the Prior Art

Cartons or containers which are used to carry food products, particularly those in liquid form, must be securely sealed at those areas where the paperboard is joined in order to prevent leaks or contamination from material outside the package. Moreover, many common adhesive materials cannot be used to form the joints because such adhesives may not be compatible with food products, or may deteriorate in the presence of moisture, or may not provide the strong air-tight and liquid-tight seals that are required.

Food containers have been made by coating portions of the surface of the container blank with a material which can be activated by heat with sealing being obtained upon joining of the proper surfaces. Often, the entire surface of the carton will be coated with a heat sealable material such as polyethylene in order to make the interior of the carton substantially moisture proof. A container of this type which is well adapted for use in carrying food products is a paperboard pouch formed of a single blank folded in half, with the facing longitudinal side edges being heat sealed together in a "fin" seal. After insertion of the contents of the pouch, the top edges are then sealed together to completely enclose the contents. A pouch constructed in this manner has the advantage that seals need be formed only along the side edges and top of the pouch, and not along the bottom of the pouch where the stress imposed by the contents is apt to be greatest.

A number of machines have been developed that provide for the automatic formation and sealing of paperboard cartons or plastic material which is heat sealable. Examples of such machines capable of forming heat sealed cartons are shown in U.S. Pat. Nos. 3,448,588; 3,593,623; and 3,785,255. U.S. Pat. Nos. 3,633,333; 3,200,303; 3,980,515; and 4,019,946 are also known to show heat sealing of material to form enclosed containers. Such machines are generally not well adapted to the rapid production of heat sealed pouches formed from a single blank wherein only the longitudinal side edges and the top of the blank are being sealed.

SUMMARY OF THE INVENTION

The apparatus of this invention is adapted to the rapid formation of heat sealed pouches formed of substantially rectangular unitary blanks. Each of the blanks has a heat sealable material coated on one of the surfaces thereof, or at least in the areas which are to be heat sealed, such as along the edges of the blank. The substantially flat, rectangular blanks are delivered to an initial position poised over opposed curved forming surfaces which converge to central guides which are spaced apart at the thickness of the pouch to be formed. A mandrel, which is initially poised above the blank in its initial position, drives longitudinally into the center of the blank and cooperates with the curved forming surfaces to fold the blank up on each side of the mandrel. As the mandrel reaches a forming position, the longitudinal edges of the blank are substantially parallel, and heated air is directed at the interior surfaces of the folded blank to activate the heat sealable material. Opposed pairs of folding plates pivot inwardly to fold the longitudinal edges of the folded blank toward engagement with one another and to conform to the outside surface of the mandrel. Opposed pairs of clamping bars thereafter clamp the longitudinal side edges of the folded pouch together and are retained in this position for a dwell period sufficient to allow the heat sealable material to cool and complete the seal. The clamping bars and folding plates are then retracted to allow ejection of the formed pouch from the mandrel.

The mandrel is preferably formed with interior passageways communicating from the top of the mandrel to openings on the sides and bottom of the mandrel. Vacuum is applied to the passageways during formation of the pouch in order to hold the blank tightly against the sides of the mandrel. After the pouch is sealed, air under pressure is injected into the passageways of the mandrel. The air pressure forces the walls of the formed pouch away from surface of the mandrel and can be sufficiently forceful as to blow the pouch completely off of the mandrel. After retraction of the mandrel and insertion of a new blank in the initial position, vacuum is again applied to the mandrel to aid in the forming of new blank.

The hot air which activates the heat sealable material on the blank is preferably supplied by air nozzles which are mounted on either side of the forming position and disposed to direct heated air to the open sides of the folded pouch. The hot air nozzles are mounted for reciprocal movement toward and away from the mandrel so as to provide heated air to the blank from a proximate position, and then withdraw to a more remote position so as not to interfere with subsequent folding and clamping of the pouch.

The apparatus is particularly adapted to forming of flat bottomed pouches. The blanks for such pouches are substantially rectangular and preferably have a centrally disposed base panel and triangular gusset panels extending outwardly from the base. The folding of this blank to form a pouch involves the folding upwardly of a central gusset panel on each side of the base as the pouch is formed, with outer gusset panels on each side of the central gusset panel then being infolded and sealed to the edges of the front and back panels of the blank. The upfolding of the central gusset panel is provided in the apparatus by folding plows mounted between the curved forming surfaces in position to engage the edges of the central gusset panels and force them upwardly as the mandrel drives the blank longitudinally between the forming surfaces. The mandrel may be adapted in shape to fit the shape of the pouch to be formed, preferably having parallel center sides and triangular end surfaces. The mandrel also preferably has an indented bottom surface to match the base panel of the blank and allow the same to bend slightly inwardly during forming, and upwardly slanted end surfaces to match the upward slant of the central gusset panels after forming of the pouch.

Further objects, features and advantages of the invention will be apparent from the following detailed description taken in conjunction with the accompanying drawings showing a preferred embodiment of pouch forming apparatus in accordance with the invention.

DESCRIPTION OF THE PREFERRED EMBODIMENT

Figure 1:
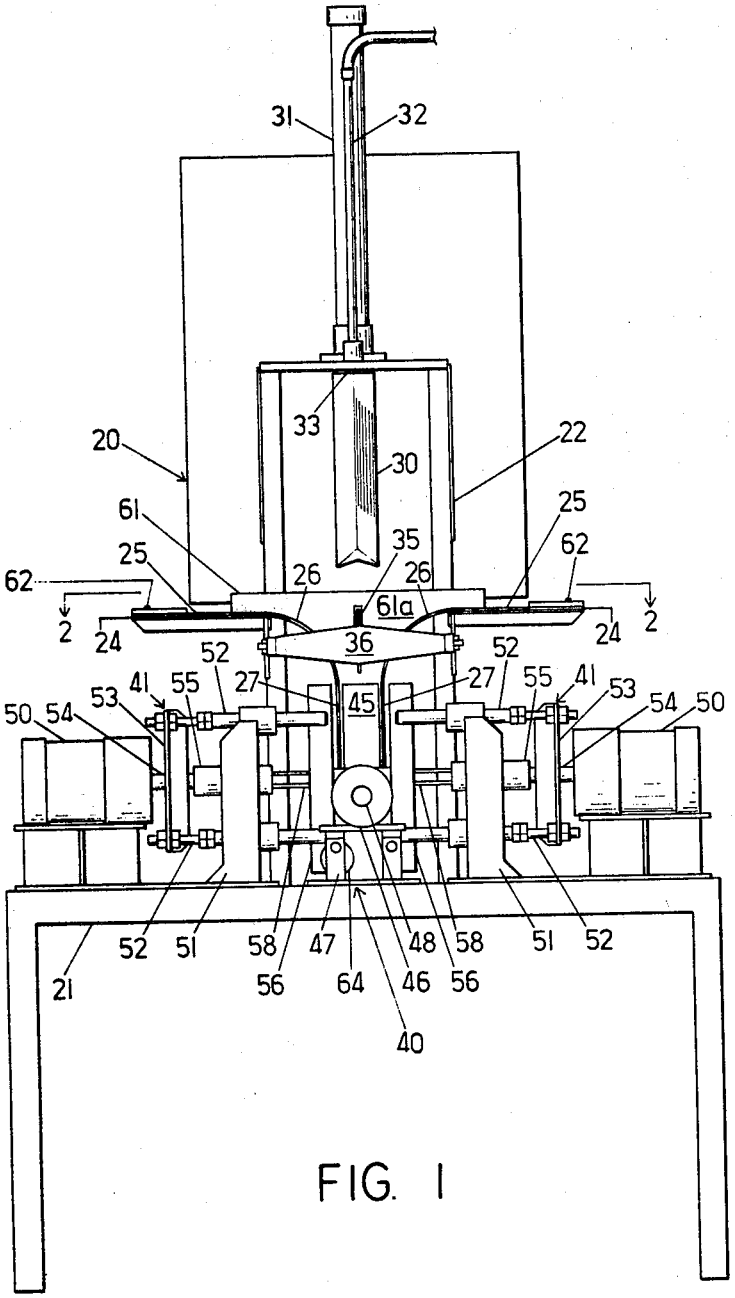
FIG. 1 is a front elevation view of the apparatus of the invention.

With reference to the drawings, the pouch forming apparatus of the invention is shown generally at 20 in front elevation in FIG. 1. The apparatus is supported above the floor by a forming table 21 to which a central support frame 22 is mounted. Paperboard blanks are delivered to an initial position defined between a pair of guide members 24 which are mounted to the support frame.

The guide members 24 are substantially identical, and each have a flat upper support surface 25, an arcuate curved forming surface 26 and a lower guide plate 27. The curved forming surfaces 26 are mounted in opposing relation and curve uniformly from the support surfaces 25 to meet the longitudinally disposed lower guide plates, which are spaced apart a distance substantially equal to the desired thickness of the pouch to be formed. A mandrel 30 is mounted to the support frame 22 for reciprocating movement between the forming surfaces 26 and guide plates 27 in what will be denoted herein as the longitudinal path of travel. The mandrel is reciprocally driven by an air pressure drive cylinder 31. An air line 32 is connected to a top input port 33 of the mandrel and provides either air pressure or vacuum pressure to the mandrel, for the reasons explained in further detail below.

A longitudinally disposed plow member 35 is positioned just below the center edge of a blank in the initial position and is mounted to the frame 22 by a plow mounting member 36. A similar longitudinally disposed plow member (not shown) is located on the opposite side of the initial blank position. The plow members 35 are located in position to engage the opposite edges of the blank, as it is pushed downwardly by the mandrel 30, and to fold such edges upwardly as described in further detail below.

The downward longitudinal stroke of the mandrel 30 drives the blank to a forming position, in which the blank has been folded in half about the mandrel and is ready to be heat sealed into a pouch form. The folding and heat sealing of the blank about the mandrel is accomplished by a pair of folding and clamping mechanisms 41 which are mounted to the forming table 21 on opposite sides of the forming position. Also supported on the table at the forming position are a pair of hot air nozzles 45, only one of which is shown in FIG. 1. The nozzles 45 are mounted at right angles to the mounting of the folding and clamping mechanisms 41 in position to direct heated air at the folded blank in the forming position. The nozzles 45 receive hot air from electric heating cylinders 46 which are themselves mounted on a slide frame 47 for sliding backward and forward movement.

The clamping and folding mechanisms 41 are substantially identical, and each has a reciprocally acting air cylinder 50, a slide mounting frame 51, slide bars 52 which are mounted to slide backwardly and forwardly on the mounting frame 51, a support plate 53 connected to the piston rod 54 of the air cylinder 50 and to the slide bars 52, and a spring loaded plunger 55 which is also connected to the support plate 53. Clamping bars 56 are rigidly mounted on the ends of the slide rods 52 and move in reciprocal motion therewith. The spring loaded piston 55 is connected to a linkage 58 which operates the folding mechanism (not shown in FIG. 1).

Figure 2:
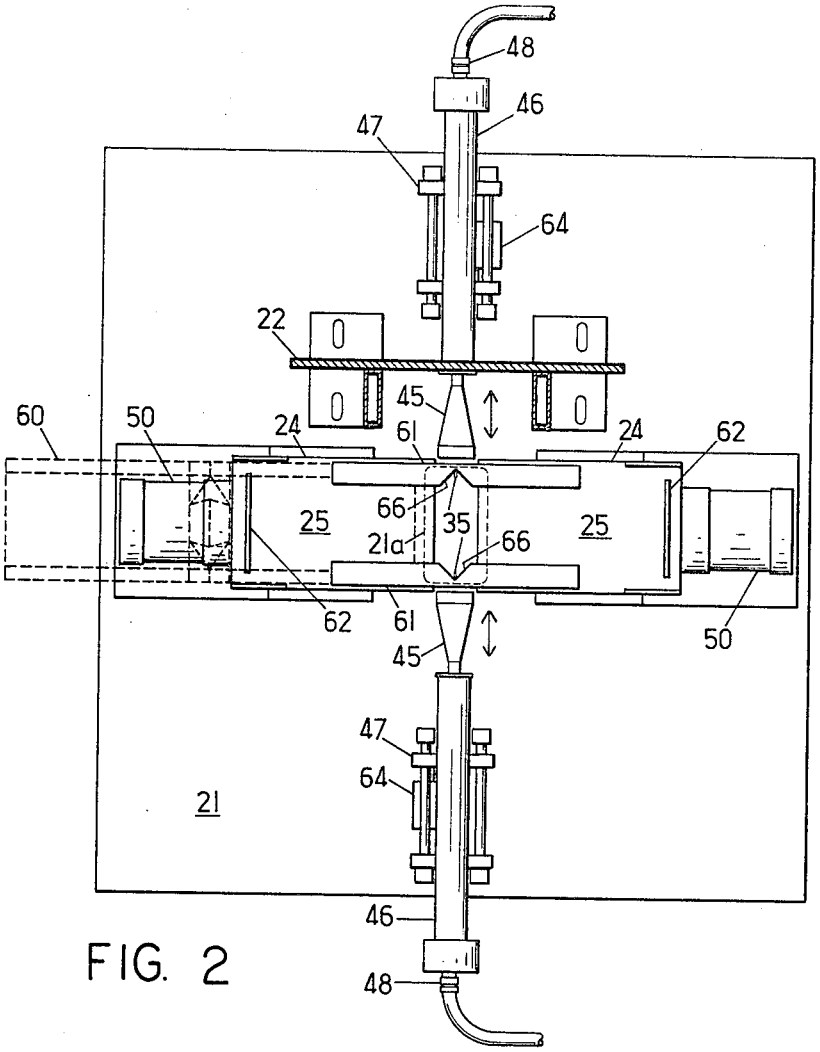
FIG. 2 is a top plan view of the apparatus taken along the line 2—2 of FIG. 1.

A top view of the apparatus, taken along the line 2—2 of FIG. 1, is shown in FIG. 2. A substantially rectangular paperboard blank 60, shown in dashed lines for illustrative purposes, is placed on one of the substantially flat support surfaces 25 and is pushed along this surface over the opening between the forming surfaces 26 and onto the opposite support surface 25. Overhanging guide bars 61 are mounted to the guide plates 24 and extend inwardly over the path of the blank. The inward motion of the blank is stopped by a detent bar 62 mounted laterally across the other support surface 25. The position of the detent bar 62 is such that when the end of the blank engages the bar, the center portion of the blank will be centered between the two forming surfaces 26. A second detent bar 62 is preferably mounted on the first support surface so that a blank will be positively located in its proper initial position between these bars. An opening is formed in the forming table 21 under the space between the forming surfaces, as indicated by the dashed lines labeled 21*a* in the view of FIG. 2, in order to allow formed pouches to be ejected downwardly through the forming table and to a receiving area where they may be collected for further processing.

The hot air nozzles 45 are shown moved toward their inward position in FIG. 2 in which they direct heated air to the inner sides of the open folded blank to activate the heat sealing material on the blank. The nozzles 45 are advanced and retracted by air operated drive cylinders 64 which have the drive rods thereof connected to the heating cylinders 46. Air under pressure is directed to the heating cylinder 46 by air tubes 48 which are supplied with a controlled source of compressed air. The heating cylinders 46 are of standard construction, utilizing electric resistance heating coils (not shown) to heat the moving air. In the retracted position the heated air emanating from the nozzles is sufficiently diffused to the sides so as not to overheat the blank or the clamping and folding mechanisms.

The overhanging guide bars 61 shown in FIG. 2 are especially adapted for use with a pouch blank suited for forming a flat bottom pouch having upwardly turned triangular gusset panels at the edges thereof. For this reason, the guide bars 61 have triangularly shaped notches 66 formed therein which allows the triangular edges of the mandrel adapted for such blanks to pass without interference. It will be seen from an examination of FIG. 2 that the longitudinally disposed folding plows 35 extend inwardly beyond the edges of the blank, in position to catch the edges and fold the same upwardly when the blank is pushed longitudinally downward by the mandrel. Side plates 61*a* preferably extend downward from the guide bars 61 and are shaped to conform to the curved forming surfaces. The side plates bracket the path of a blank being inserted into the initial position and ensure proper centering of the blank.

Figure 3:
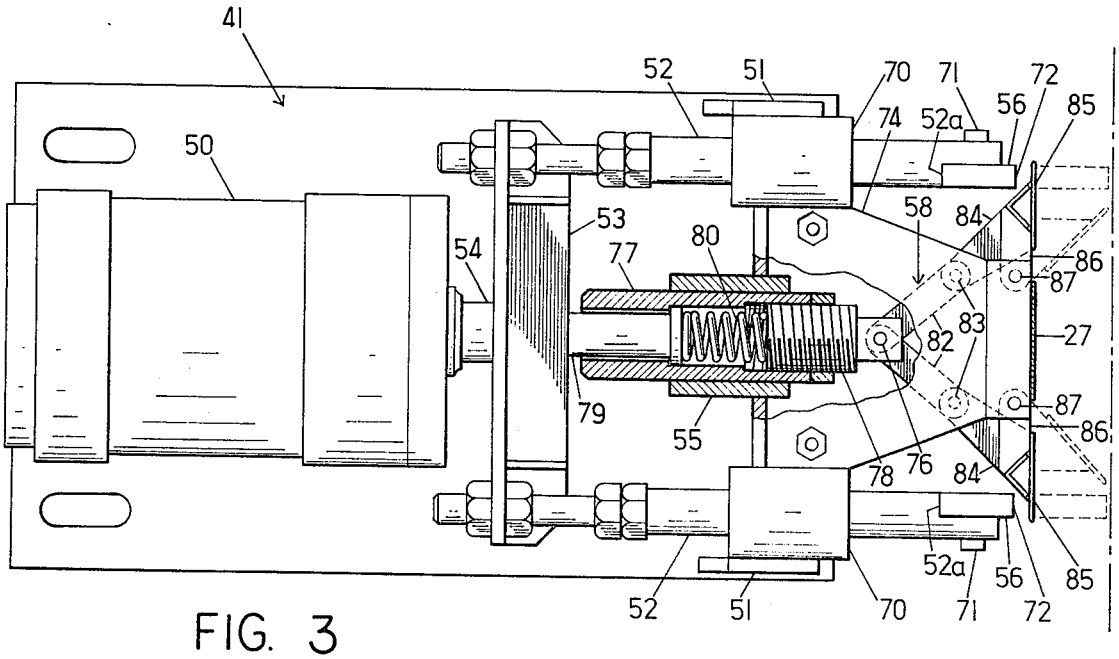
FIG. 3 is a top view of the folding and clamping mechanism of the apparatus showing the details thereof.

The clamping and folding mechanism 41 on the left-hand side of the view of FIG. 1 is shown in a top detail view in FIG. 3, it being understood that the right-hand mechanism is identical in construction. As best shown in the view of FIG. 3, the slide bars 52 extend through bushings 70 which are mounted to the frame members 51. The slide bars 52 terminate at their ends in a notched out portion 52*a* in which the clamping bars 56 are mounted and rigidly held by machine screws 71. The end of each of the clamping bars 56 preferably has silicone rubber facing 72 adhered thereto to facilitate release of these surfaces from the paperboard blank after sealing has been accomplished.

A mounting bracket 74 is rigidly connected between the bushings 70 and extends forwardly to attachment to the guide plate 27 to rigidly hold the same in a longitudinal position. A portion of the mounting bracket 74 has been shown cut away in FIG. 3 to allow a partial view of the folder linkage 58 below. The linkage 58 is connected by a pivot pin 76 to the end of the spring loaded plunger 55. The plunger itself is shown in cross-section in FIG. 3 and consists of a cylindrical body 77, a threaded stud 78 which is screwed into the cylindrical body and is attached at its outer end to the pivot pin 76, a piston member 79 slidably movable within the body 77 and threadingly attached at its end to the support plate 53, and a spring 80 compressable between the stud 78 and the piston 79.

The linkage 58 has two first links 82 mounted at one end by the pivot pin 76 to the plunger stud 78 and connected at their outer ends by pivots 83 to links 84. The links 84 are themselves rigidly connected to a pair of longitudinally disposed folding plates 85 mounted on either side of the guide plate 27 in substantially co-planar initial relation therewith. The folding plates 85 have links 86 rigidly attached thereto which are connected by pivots 87 to the mounting bracket 74.

The forwardly pivoted positions of the folding plates 85 are shown in dashed lines for illustrative purposes in FIG. 3. As the drive rod 54 of the piston 50 drives the support plate 53 forwardly, the plunger 55 and the slide rods 52 will be moved forwardly. The forward movement of the piston 79 against the spring 80 will force the plunger body forwardly and will cause the linkage 58 to pivot the folding plates 85 inwardly about the pivot points 87 and into contact with the sides of the folded blank in the forming position. At the same time, the clamp bars 56 will be driven forwardly by the slide bars 52. At the approximate maximum inward rotation of the folding plates 85, they will bring the longitudinal edges of the blank into abutment and will firmly press the sides of the folded blank against the mandrel and will be unable to travel further inwardly. However, the clamping bars 56 will still continue to move inwardly, and the piston 79 of the plunger will move inwardly with respect to the plunger body, further compressing the spring 80. The opposed clamp bars will eventually move into firm clamping contact with the longitudinal abutting edges of the blank to hold the same in contact to form a seal as the heat sealable material cools below its melting temperature.

After formation of the heat seal, the drive cylinder 50 drives the support plate 53 backwardly, which immediately pulls the clamping bars 56 away from the formed pouch. However, the folding plates 85 remain in contact with the pouch and away from interference with the clamping bars because the spring 80 exerts a force against the linkage 58 as long as it remains compressed. When the clamp bars 56 have been retracted sufficiently that inward rotation of the folding plates will not be interferred with, the piston 79 reaches the end of its travel and engages a shoulder formed on the inner surface of the plunger body 77 to thereby withdraw the folding plates back to their initial position substantially coplanar with the guide plate 27.

Figure 6:
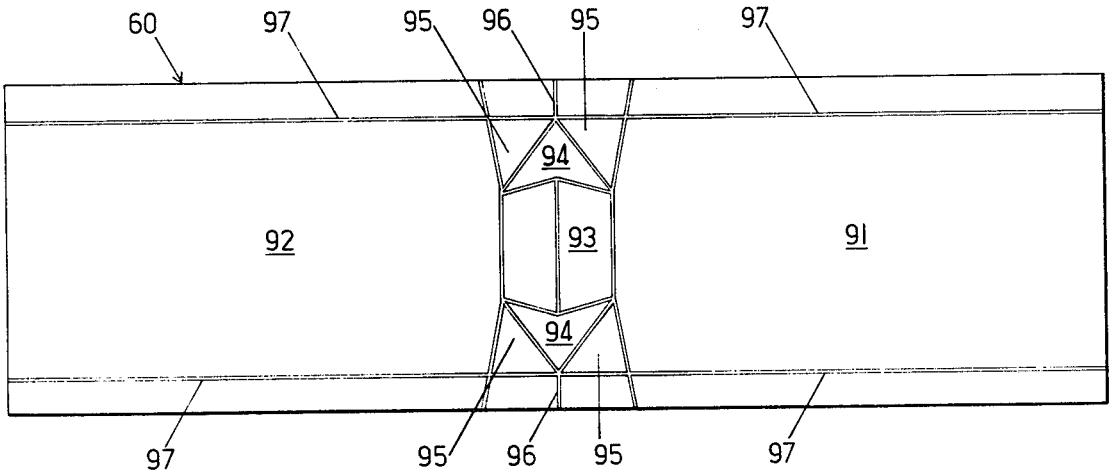
FIG. 6 is an elevation view of a flat blank carton which can be used to form pouches in the apparatus.

A type of paperboard blank to which the apparatus can be particularly adapted for efficient pouch formation is shown in FIG. 6. The blank 60 shown therein is substantially rectangular and has a front panel 91, a back panel 92, a base panel 93, triangularly shaped gusset panels 94 extending outwardly from the base panel and pairs of triangular shaped gusset panels 95 extending from the base panel to the edge of the blank between the central gusset panel 94 and the front and back panels 91 and 92 respectively. Separation of the various panels is defined by score or crease lines in the blank. Score lines 96 are preferably formed at the longitudinal edges of the blank extending outwardly from the apex of the central gusset panels 94 to the edges of the blank. Additional score or fold lines 97 extend parallel to the longitudinal edges of the blank and spaced slightly inwardly thereof. At least one surface of the blank, and possibly both surfaces, are preferably coated with a material which is activatible by application of heat to allow heat seals to be formed. A typical coating material that allows good heat seals to be formed and is compatible with food products is polyethylene.

As an alternative to coating the entire surface of the blank with the heat sealable material, only those areas between the edge score lines 97 and the edges of the blank may have a coating applied thereto since generally these will be the only areas which will be sealed. The remaining areas of the blank will be uncoated, and thus a pouch formed from such a blank would not be suited to containing a moist material or a material sensitive to external moisture.

Figure 4:
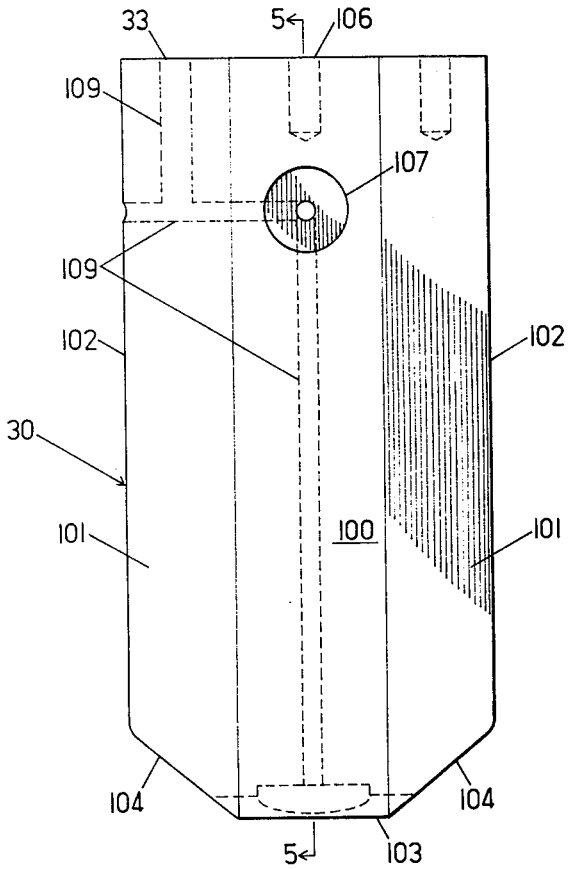
FIG. 4 is a side elevation view of the mandrel.
Figure 5:
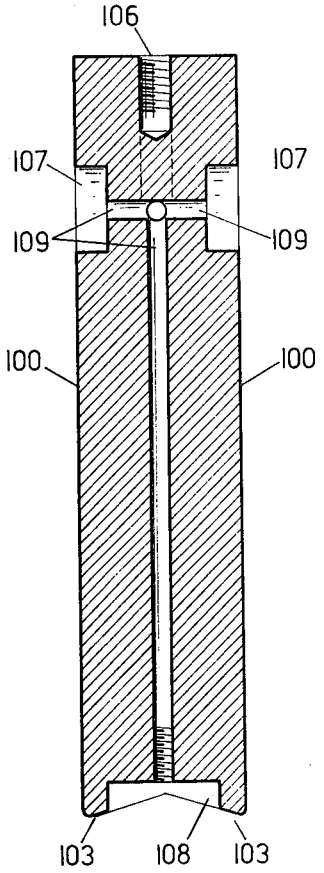
FIG. 5 is a cross-sectional view of the mandrel taken along the line 5—5 of FIG. 4.

A mandrel adapted to the formation of sealed pouches from the blank of FIG. 6 is shown in FIG. 4 in front elevation. The mandrel 30 shown therein has opposite flat parallel center sides 100 and converging triangular shaped end surfaces 101 which converge from the center sides to outer longitudinally extending edges 102. A substantially rectangular upwardly indented bottom surface 103 defines the bottom of the mandrel, with upwardly slanting surfaces 104 extending therefrom upwardly and outwardly to the outer longitudinal edges 102 of the mandrel. The top of the mandrel has a threaded socket 106 therein to allow engagement with the piston rod of the drive cylinder 31. Recessed openings 107 are provided in the parallel flat surfaces 100 for the reasons described below. With reference to the cross-sectional view of the mandrel shown in FIG. 5, a recessed opening 108 is also provided in the bottom surface 103 of the mandrel.

Walls defining passageways 109 extend through the mandrel and place the recessed openings 107 and 108 in communication with each other and also in communication with the port 33 on the top surface of the mandrel. The passageways 109 are shown in dashed lines in the elevation view of FIG. 4 to illustrate the relative position of these passageways with the body of the mandrel. The port 33 at the top of the mandrel is engaged in air-tight relation to the air line 32 for the supply of either vacuum pressure or air pressure to the mandrel passageways as appropriate. Application of vacuum to the mandrel will cause the front, back and base panels of the blank to be drawn up tight against the surfaces 100 and 103 of the mandre'uo aid in the forming operation. After the blank has been formed and sealed into a pouch, provision of air under pressure to the recesses 107 and 108 will blow the pouch away from the mandrel and eject it from the forming position through the opening 21*a* in the table 21. Rubber or plastic suction cups (not shown) may be mounted in the openings 107 and 108 if greater suction of the blank side panels to the mandrel is desired.

Figure 7:
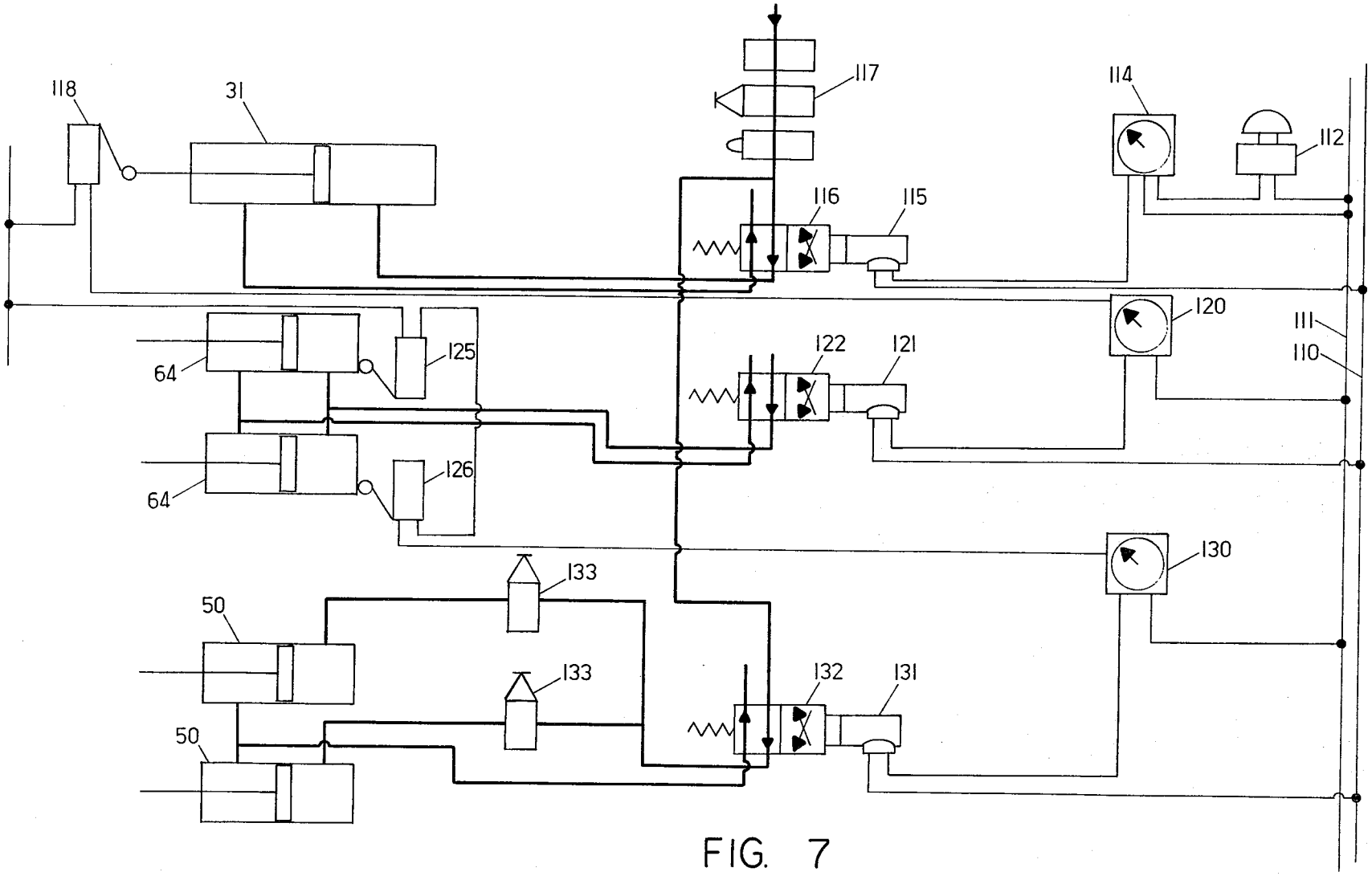
FIG. 7 is a schematic diagram of the controls for the apparatus.

The controls for controlling the sequence of operation of the apparatus are shown in schematic form in FIG. 7. Standard AC power lines 110 and 111 provide power to a start button 112 which, when depressed, activates a timer 114 which provides electrical continuity therethrough for a selected period of time before turning off. Power from the timer 114 is delivered to the solenoid 115 of a two-position four-way spring loaded valve 116. Activation of the solenoid drives the valve to its position shown in FIG. 7 wherein air under pressure is delivered from an oiler, regulator and filter unit 117 to the mandrel drive cylinder 31 to drive the mandrel downwardly. The mandrel continues driving downwardly until the piston reaches the limit of its drive and the mandrel is in the forming position, and while doing so, the mandrel drive cylinder closes a limit switch 118 which supplies electrical power to another timer 120. The second timer 120 thereafter provides electrical continuity from the power lines 110 and 111 to the solenoid 121 of a solenoid operated two-position spring loaded four-way valve 122.

In its activated position, as shown in FIG. 7, the valve 122 provides air under pressure to the heating nozzle drive cylinders 64 to drive the heating nozzles into their inward positions proximate to the open ends of the folded paperboard blank in the forming position. After a predetermined time period the timer 120 discontinues supply of electric power to the solenoid 121, thereby switching the valve 122 and supplying air pressure to the cylinders 64 to drive the cylinders to their retracted positions.

When fully retracted, the drive rods of the drive cylinders 64 close normally open serially connected limit switches 125 and 126. When both of these switches are closed, they supply power to a third timer 130. When activated, the timer 130 supplies power for a predetermined period of time to the solenoid 131 of a four-way spring loaded two-position control valve 132. When activated by the solenoid 131, the valve 132 supplies air under pressure through pressure regulators 133 to the drive cylinders 50 of the folding and clamping mechanisms. The regulators 133 provide a controlled air pressure to the pistons 50 so that the clamping pressure applied by the clamping bars is controlled, as well as controlling the rate which the clamping bars and folding plates are extended and retracted. The timer 130 is set to provide a predetermined dwell time of the clamping bars on the edges of the container, which generally will be in the range of 2 to 5 seconds, after which the timer 130 disconnects power to the solenoid 131, thereby causing the valve 132 to direct air under pressure to the drive cylinders 50 to retract the folding and clamping mechanism.

The first timer 114 is set to disconnect power to the solenoid 115 after the clamping and folding cycle has been completed, and the timer 130 has been shut off. When the timer 114 ceases to supply power to the solenoid 115, the valve 116 is switched to its retract position to supply air under pressure to the mandrel cylinder 31 to draw the same upwardly to its initial position. Initiation of a new cycle then begins with the activation of the start button 112. It is clear that the initiation of the cycle may be determined automatically, for example, by providing the start button 112 as a limit switch located at the detent bar 62 in position to be closed by a blank which has been inserted into its initial position. It is apparent that feeding of blanks to the initial position can be provided automatically from a magazine of blanks, as is well known in the packaging art, and such a feeding mechanism has not been shown herein since it is not essential to the invention.

Figure 8:
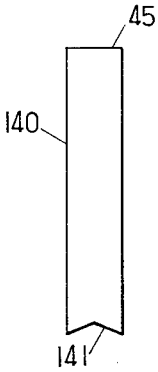
FIG. 8 is a front elevation view of the hot air nozzle portion of the apparatus.
Figure 9:
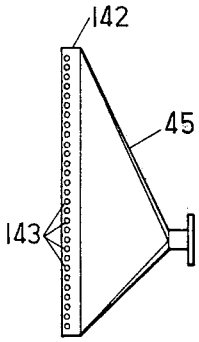
FIG. 9 is a side elevation view of the hot air nozzle.

A preferred construction of the hot air nozzles 45 adapted for use with flat bottomed blanks is shown in FIGS. 8 and 9. As shown in FIG. 8, the front of the nozzle 45 is sealed off by a front plate 140, and the bottom of the nozzle has upwardly indented edges 141 to conform to the upwardly folded gusset panels of the blank 60. The flat side edges 142 of the nozzle and the indented bottom edges 141 have a plurality of holes 143 formed therein to precisely direct heated air at the edges of the blank only, as explained further below.

Figure 10:
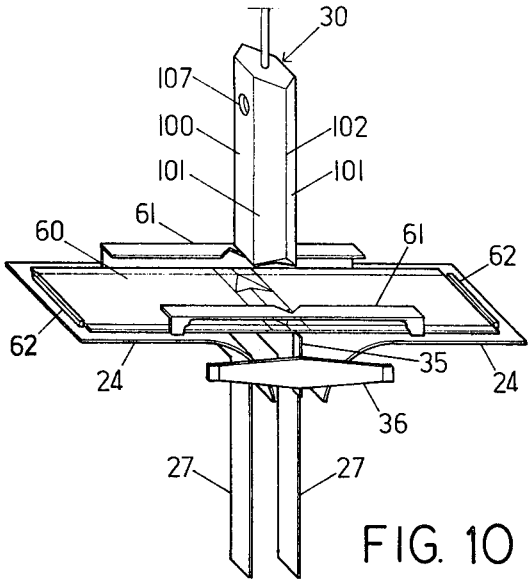
FIG. 10 is a simplified perspective view of the mandrel poised above the blank wherein the blank is in its initial position above the curved forming surfaces.
Figure 11:
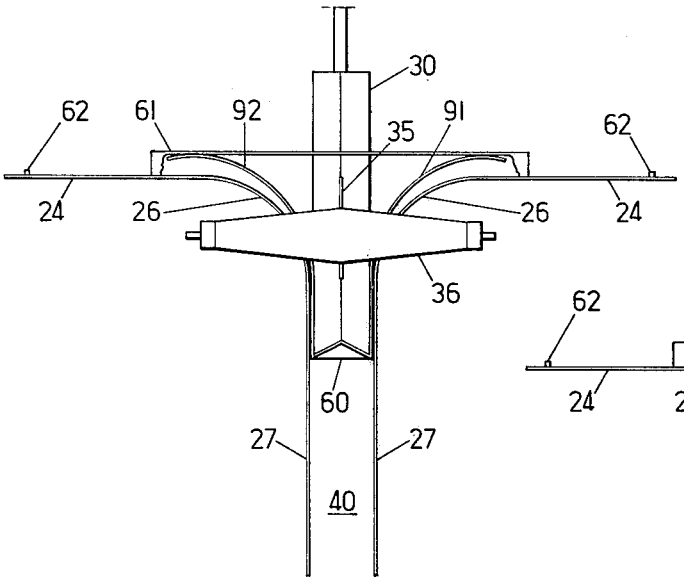
FIG. 11 is a side elevation view of the blank partially pushed down by the mandrel between the curved forming surfaces.

The sequence of operations of the apparatus 20 is best illustrated with reference to the views of FIGS. 10–15. FIG. 10 shows the blank 60 in its initial position with the mandrel 30 poised in position to have the bottom surface of the mandrel engage the base panel of the blank as the mandrel begins its downward stroke. It can be noted, from the placement of the parts indicated in the simplified perspective view of FIG. 10, with the side plates 61*a* broken away for better illustration, that the longitudinally extending folding plow 35 is located underneath the longitudinal side edges of the blank in position to catch the blank at the middle crease lines 96 at the apexes of the central gusset panels as the mandrel forces the blank downwardly. The result of the engagement of the plow with this crease line is best illustrated in the view of FIG. 11, showing the mandrel having pushed the blank partially downward. The action of the plow 35 on the edge of the blank causes the triangular shaped gusset panels 94 to be pushed upwardly along with the edges of the blank. The slanted bottom side edges 104 of the mandrel 30 allow the gusset panels 94 to be pushed upwardly without interference by the mandrel. It is noted from an examination of the view of FIG. 11 that the horizontally extending guide bars 61 hold the ends of the blank to cause the front and back panels 91 and 92 to become bent around the curved forming surfaces 26 as the blank is pushed downwardly. This action of the guide bars helps to maintain the blank in its properly centered position as it is initially being pushed down, so that it does not tend to slide off to one side or the other. Additionally,Puhe action of the vacuum applied to the openings 107 and 108 in the mandrel help to keep the base panel 93 and the front and back panels 91 and 92 closely held to the mandrel as it proceeds downwardly between the forming surfaces.

Figure 12:
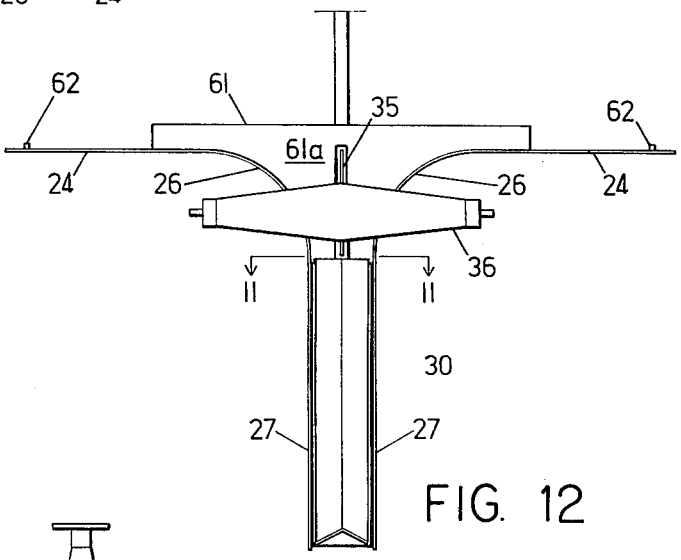
FIG. 12 is a side view of the mandrel and blank in the forming position.

The mandrel is shown in its full extension in the forming position in FIG. 12. In this position, the bottom panel 93 of the blank is closely held by vacuum to the bottom surface 103 of the mandrel, whereas the front panel 91 and back panel 92 of the blank are closely held in substantially straight up and down position between the center side surfaces 100 of the mandrel and the surfaces of the guide plates 27.

Figure 13:
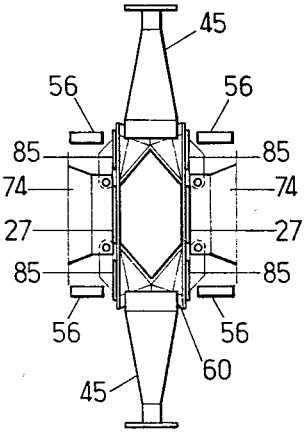
FIG. 13 is a simplified top view, taken along the line 13—13 of FIG. 12, showing the folding plates and the clamping bars in position to engage the folded blank in the forming position.

A simplified top view of the mandrel and blank in the forming position is shown in FIG. 13, which corresponds to a top view taken along the line 13—13 of FIG. 12. As described above, when the mandrel and the blank are in the forming position, the hot air nozzles 45 are advanced into proximity with the open folded ends of the blank, to direct a hot air blast at the inside surfaces of the blank through the edge openings 143 and thereby activate the heat sealable material on the inner surfaces of the blank. During application of hot air to the blank, the folding plates 85 and clamping bars 56 are in their retracted position.

Figure 14:
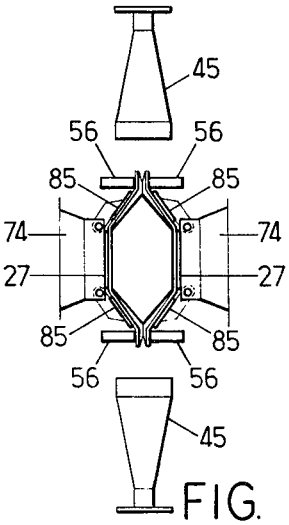
FIG. 14 is a simplified top view as in FIG. 13, showing the folding plates in engagement with the sides of the pouch material and the clamping bars partially extended.

After hot air has been applied by the nozzles 45 for a sufficient period of time to activate the heat sealable material, the nozzles are retracted, and the folding plates 85 are advanced to fold the longitudinal sides of the blank inwardly toward the mandrel. This action is shown in the view of FIG. 14, wherein the folding plates have been shown advanced to their innermost position. The action of these inward pivoting folding plates not only causes the sides of the blank to generally be pushed in to conform to the outside shape of the mandrel, but also causes the longitudinal side edges of the front panel 91 and back panel 92 of the blank to be brought into contact with each other.

Figure 15:
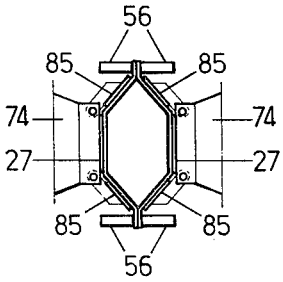
FIG. 15 shows the clamping bars fully engaged with the edges of the pouch and holding the same together to complete the seal.

As described above, the folding plates 85 lead the clamping bars 56 and advance to their innermost position before the clamping bars come into contact with the blank. Completion of the seal is formed as the clamping bars come into firm opposed sealing contact with the abutting longitudinal side edges of the blank, as shown in FIG. 15. After a sufficient dwell time to allow the heat sealable material on the inside surfaces of the pouch to cool below the sealing temperature, the clamping bars are withdrawn to their retracted position with the folding plates 85 following them. After complete release of the folding clamps, the formed pouch is ejected from the forming position, preferably by injection of compressed air into the inner passageways 109 of the mandrel so that the formed pouch is thereby blown downwardly off of the mandrel.

Alternatively, the mandrel may be charged with compressed air and withdrawn upwardly when the clamping bars are holding the edges of the blank. After the clamping bars release contact, the formed pouch will be pushed downwardly out of the forming position as the mandrel moves down carrying the next blank to be formed.

While the above described sequence of steps is especially adapted to the formation of a pouch from the blank shown in FIG. 6, it is apparent that the apparatus of the invention can be utilized to form other types of blanks into sealed pouches. The apparatus is generally capable of forming rectangular blanks into folded pouches having heat seals along the longitudinal side edges of the pouch.

After ejection of the formed and sealed pouch from the apparatus, it may be directed as desired to a location where the product may be filled into the pouch, whereupon the top of the pouch may be heat sealed together across the top opposed edges of the pouch in accordance with standard procedures.

It is understood that the invention is not confined to the particular construction and arrangement of parts herein illustrated and described, but embraces all such modified forms thereof as come within the scope of the following claims.

We claim:

1. Apparatus for forming substantially rectangular paperboard blanks into heat sealed pouches, wherein the blanks have a heat activated sealing material on at least the portions of the surfaces thereof which are to be heat sealed together, comprising:

(a) a mandrel adapted to have a paperboard blank shaped therearound and having at least one opening on its surface adjacent a wall of a pouch formed from the blank, and walls defining passageways within said mandrel providing communication between the opening at the surface of the mandrel and a port on said mandrel not adjacent to a pouch formed about said mandrel;

(b) means for driving said mandrel in a reciprocal path of longitudinal travel;

(c) curved forming surfaces disposed on opposite sides of the path of travel of said mandrel and adapted to support a paperboard blank in an initial position in the path of travel of said mandrel, substantially flat support surfaces which extend into said curved forming surfaces, said forming surfaces curving uniformly from the flat support surfaces to a pair of flat lower guide plates extending from the bottom of said curved forming surfaces on either side of the longitudinal path of travel of said mandrel, said forming surfaces being adapted to cooperate with said mandrel to fold a paperboard blank in the initial position longitudinally about said mandrel as said mandrel drives the paperboard blank between said curved forming surfaces to a forming position;

(d) means for providing air under vacuum to said port in said mandrel to draw the paperboard blank toward said mandrel as said mandrel drives the blank to the forming position;

(e) means for directing heated air at the blank to activate the heat sealable material on the surfaces of the blank;

(f) means for folding in the sides of the folded blank on said mandrel in the forming position after activation of the heat sealable material on the blank to bring the longitudinal edges of the folded blank into abutting relationship;

(g) clamping means including clamping bars disposed on either side of the abutting lonitudinal edges of the folded blank for clamping the abutting longitudinal edges of the folded blank together between said clamping bars for a dwell time sufficient to cool the abutting surfaces and seal the same, and for retracting the clamping bars after the seal has been completed, thereby providing a pouch sealed about said mandrel on all sides thereof except the top of the pouch wherefrom the mandrel may be withdrawn; and (h) means for selectively injecting air under pressure to said port in said mandrel to blow such air into the pouch and thereby blow it away from the mandrel.

2. The apparatus of claim 1 wherein said mandrel has opposite flat parallel center sides, a bottom surface, triangularly shaped end surfaces converging from said center sides to longitudinal edges, and upwardly slanted surfaces extending from said bottom surface upwardly and outwardly to said longitudinal edges.

3. The apparatus of claim 1 including substantially flat support surfaces which extend into said curved forming surfaces, said forming surfaces curving uniformly from the flat support surfaces to a pair of flat lower guide plates extending from the bottom of said curved forming surfaces on either side of the longitudinal path of travel of said mandrel.

4. Apparatus adapted for forming heat sealed pouches from the substantially rectangular paperboard blanks having a front panel, a back panel, a base panel therebetween, triangularly shaped central gusset panels extending outwardly from the base panel, and pairs of triangularly shaped gusset panels extending from the base panel to the edge of the blank between the central gusset panel and the front and back panels respectively, wherein the blanks have a heat activated sealing material on at least the portions of the surfaces thereof which are to be heat sealed, the apparatus comprising:

(a) a mandrel having opposite flat parallel center sides, a bottom surface, triangularly shaped end surfaces converging from said center sides to longitudinal edges, upwardly slanted surfaces extending from said bottom surface upwardly and outwardly to said longitudinal edges, at least one opening formed on the surface of said mandrel adjacent a wall of the formed pouch, walls defining passageways within said mandrel providing communication between said openings at the surface of said mandrel and a port on said mandrel not adjacent to a pouch formed about said mandrel;

(b) means for driving said mandrel in a reciprocal path of longitudinal travel;

(c) curved forming surfaces disposed on opposite sides of the path of travel of said mandrel, substantially flat support surfaces extending into said curved forming surfaces, said forming surfaces curving uniformly from said flat support surfaces to a pair of flat lower guide plates extending from the bottom of said curved forming surfaces on either side of the longitudinal path of travel of said mandrel, said flat support surfaces and curved forming surfaces adapted to support a paperboard blank in an initial position with the base panel of the blank underneath the bottom surface of said mandrel in position to be engaged thereby as said mandrel is driven downwardly, said curved forming surfaces adapted to cooperate with said mandrel to fold the paperboard blank longitudinally about said mandrel with the base panel of the blank in contact with the bottom surface of said mandrel and the front and back panels of the blank in contact with the center sides of the mandrel as said mandrel drives the paperborad blank between said curved forming surfaces to a forming position;

(d) means for providing air under vacuum to said port in said mandrel to draw the paperboard blank toward said mandrel as said mandrel drives the blank to the forming position;

(e) means for directing heated air at the blank to activate the heat sealable material on the surfaces of the blank;

(f) means for folding in the sides of the folded blank on said mandrel in the forming position after activation of the heat sealable material on the blank to press the front and back panel about said mandrel and into contact with said triangularly shaped end surfaces of said mandrel and to bring the longitudinal edges of the folded blank into abutting relationship;

(g) clamping means including clamping bars disposed on either side of the abutting longitudinal edges of the folded blank for clamping the longitudinal edges of the folded blank together between said clamping bars for a dwell time sufficient to cool the abutting surfaces and seal the same, and for retracting the clamping bars after the seal has been completed, thereby providing a pouch sealed about said mandrel on all sides thereof except the top of the pouch wherefrom the mandrel may be withdrawn; and (h) means for selectively injecting air under pressure to said port in said mandrel to blow such air into the pouch and thereby blow it away from the mandrel.

5. The apparatus of claim 4 or 3 wherein said means for folding in the sides of the blank comprises opposed pairs of folding plates pivotally mounted on opposite sides of said guide plates for rotation from a position substantially coplanar with the guide plates to an inward position toward said mandrel when in the forming position and to thereby fold the blank about said mandrel and bring the longitudinal edges of the folded blank into abutment, and wherein said clamping means includes pairs of longitudinally disposed clamping bars mounted for reciprocating inward and outward movement, toward and away from the abutting longitudinal edges of a folded blank in said forming position, in coordination with the pivoting of said folding plates, and drive means for driving said clamping bars into firm clamping contact with the longitudinal edges of the folded blank in coordination with the pivoting of said folding plates, and for driving said clamping bars away from the longitudinal edges of a blank in the forming position after sealing has been completed to allow ejection of the formed pouch from said mandrel.

6. The apparatus of claim 5 including a mounting frame, slide bars slidably mounted on said mounting frame for movement toward and away from the forming position, said clamping bars being rigidly mounted on one end of said slide bars and a support plate attached to said slide bars at the other end thereof, a spring loaded plunger having a piston member mounted to said support plate and movable within the plunger body, a spring compressible between said piston member and the plunger body, and a stud on said plunger, linkage means connected to said stud of said plunger and to said folding for turning the folding plates inwardly and retracting them outwardly in coordination with the movement inwardly and outwardly of said plunger, and a drive cylinder having the drive rod thereof connected to said support plate and responsive to fluid under pressure provided to said drive cylindesbuo drive said support plate inwardly and outwardly, said spring loaded plunger and said linkage means arranged to provide resilient inward pivoting movement of said folding plates in responsive to inward movement of said support plate driven by said drive cylinder, whereby said folding plates pivot inwardly in coordination with and leading said clamping bars, and are resiliently held in firm contact with a blank folded about said mandrel when said clamping bars are in contact with the longitudinal edges of the folded blank.

7. The apparatus of claim 1 or 4 including timing and control means for actuating said drive means for said mandrel to drive the same downwardly into a blank in the initial position and to drive the mandrel and blank to the forming position, and to maintain said mandrel in the forming position for a preselected period of time, for activating said means for directing heated air to heat the surfaces of the folded blank in the forming position for a preselected period of time, for activating said folding means after the surface of the blank has had heated air directed thereto to fold the blank inwardly about said mandrel, for activating said clamping means after the blank has been folded inwardly by said folding means to clamp the longitudinal side edges of the blank firmly together for a preselected dwell time to complete the heat seal, for thereafter withdrawing said clamping means and said folding means to release the sealed pouch and for activating said drive means to withdraw said mandrel from said forming position after release of the formed pouch therefrom.

8. The apparatus of claim 2 or 7 wherein said mandrel has openings in the opposite parallel center sides and the bottom surface thereof, walls defining passageways in said mandrel connecting said openings to a port at the top of said mandrel, and including means for supplying air under vacuum pressure to said port in said mandrel as said mandrel drives the blank to the forming position and for supplying air under pressure to said port in said mandrel when the seal between the longitudinal edges of the blank has been completed to thereby force the formed pouch away from the mandrel by the pressure of air in the pouch.

9. The apparatus of claim 1 or 2 wherein said means for directing heated air to the blank includes a pair of air directing nozzles mounted for sliding back and forth movement on either side of the forming position of said mandrel and having a closed off front surface, side and bottom edges, and a plurality of openings in said side and bottom edges in position to direct heated air therethrough at a pouch blank folded about said mandrel, means for heating air under pressure supplied to said nozzles, and means for driving said nozzles inwardly to a close proximate position to said mandrel in the forming position and for retracting said nozzles from said close proximate position to a retracted position.

10. The apparatus of claim 4 including longitudinally disposed plow members mounted on opposite sides of the path of travel of said mandrel in position to engage the edges of the blank at the apexes of the triangular shaped center gusset panels to fold the same upwardly as the mandrel drives the blank downwardly between said curved forming surfaces.

11. Apparatus for forming substantially rectangular paperboard blanks into heat sealed pouches, wherein the blanks have a heat activated sealing material on at least the portions of the surfaces thereof which are to be heat sealed together, comprising:

(a) a mandrel adapted to have a paperboard blank shaped therearound;

(b) means for driving said mandrel in a reciprocal path of longitudinal travel;

(c) curved forming surfaces disposed on opposite sides of the path of travel of said mandrel and adapted to support a paperboard blank in an initial position in the path of travel of said mandrel, said forming surfaces being adapted to cooperate with said mandrel to fold a paperboard blank in the initial position longitudinally about said mandrel as said mandrel drives the paperboard blank between said curved forming surfaces to a forming position;

(d) means for directing heated air at the blank to activate the heat sealable material on the surfaces of the blank including a pair of air directing nozzles mounted for sliding back and forth movement on either side of the forming position of said mandrel and having a closed off front surface, side and bottom edges, a plurality of openings in said side and bottom edges in position to direct heated air therethrough at a pouch blank folded about said mandrel, means for heating air under pressure supplied to said nozzles, and means for driving said nozzles inwardly to a close proximate position to said mandrel in the forming position and for retracting said nozzles from said close proximate position to a retracted position;

(e) means for folding in the sides of the folded blank on said mandrel in the forming position after activation of the heat sealable material on the blank to bring the longitudinal edges of the folded blank into abutting relationship;

(f) clamping means including clamping bars disposed on either side of abutting longitudinal edges of the folded blank for clamping the abutting longitudinal edges of the folded blank together between said clamping bars for a dwell time sufficient to cool the abutting surfaces and seal the same, and for retracting the clamping bars after the seal has been completed, thereby providing a pouch sealed about said mandrel on all sides thereof except the top of the pouch wherefrom the mandrel may be withdrawn.

12. Apparatus adapted for forming heat sealed pouches from substantially rectangular paperboard blanks having a front panel, a back panel, a base panel therebetween, triangularly shaped central gusset panels extending outwardly from the base panel, and pairs of triangularly shaped gusset panels extending from the base panel to the edge of the blank between the central gusset panel and the front and back panels respectively, wherein the blanks have a heat activated sealing material on at least the portions of the surfaces thereof which are to be heat sealed, the apparatus comprising:

(a) a mandrel having opposite flat parallel center sides, a bottom surface, triangularly shaped end surfaces converging from said center sides to longitudinal edges, and upwardly slanted surfaces extending from said bottom surface upwardly and outwardly to said longitudinal edges;

(b) means for driving said mandrel in a reciprocal path of longitudinal travel;

(c) curved forming surfaces disposed on opposite sides of the path of travel of said mandrel, substantially flat support surfaces extending into said curved forming surfaces, said forming surfaces curving uniformly from said flat support surfaces to a pair of flat lower guide plates extending from the bottom of said curved forming surfaces on either side of the longitudinal path of travel of said mandrel, said flat support surfaces and curved forming surfaces adapted to support a paperboard blank in an initial position with the base panel of the blank underneath the bottom surface of said mandrel in position to be engaged thereby as said mandrel is driven downwardly, said curved forming surfaces adapted to cooperate with said mandrel to fold the paperboard blank longitudinally about said mandrel with the base panel of the blank in contact with the bottom surface of said mandrel and the front and back panels of the blank in contact with the center sides of the mandrel as said mandrel drives the paperboard blank between said curved forming surfaces to a forming position;

(d) means for directing heated air at the blank to activate the heat sealable material on the surfaces of the blank including a pair of air directing nozzles mounted for sliding back and forth movement and having a closed off front surface, side and bottom edges, and a plurality of openings in said side and bottom edges in position to direct heated air therethrough at a pouch blank folded about said mandrel, means for heating air under pressure applied to said nozzles, and means for driving said nozzles inwardly to a close proximate position to said mandrel in the forming position and for retracting said nozzles from said close proximate position to a retracted position;

(e) means for folding in the sides of the folded blank on said mandrel in the forming position after activation of the heat sealable material on the blank to press the front and back panel about said mandrel and into contact with said triangularly shaped end surfaces of said mandrel and to bring the longitudinal edges of the folded blank into abutting relationship;

(f) clamping means including clamping bars disposed on either side of the abutting longitudinal edges of the folded blank for clamping the longitudinal edges of the folded blank together between said clamping bars for a dwell time sufficient to cool the abutting surfaces and seal the same, and for retracting the clamping bars after the seal has been completed, thereby providing a pouch sealed about said mandrel on all sides thereof except the top of the pouch wherefrom the mandrel may be withdrawn.

13. Apparatus for forming substantially rectangular paperboard blanks into heat sealed pouches, wherein the blanks have a heat activated sealing material on at least the portions of the surfaces thereof which are to be heat sealed together, comprising:

(a) a mandrel adapted to have a paperboard blank shaped therearound;

(b) means for driving said mandrel in a reciprocal path of longitudinal travel;

(c) curved forming surfaces disposed on opposite sides of the path of travel of said mandrel and adapted to support a paperboard blank in an initial position in the path of travel of said mandrel, substantially flat support surfaces which extend into said curved forming surfaces, said forming surfaces curving uniformly from the flat support surfaces to a pair of flat lower guide plates extending from the bottom of said curved forming surfaces on either side of the longitudinal path of travel of said mandrel, said forming surfaces being adapted to cooperate with said mandrel to fold a paperboard blank in the initial position longitudinally about said mandrel as said mandrel drives the paperboard blank between said curved forming surfaces to a forming position;

(d) means for directing heated air at the blank to activate the heat sealable material on the surfaces of the blank;

(e) opposed pairs of folding plates pivotally mounted on opposite sides of said guide plates for rotation from a position substantially coplanar with the guide plates to an inward position toward said mandrel when in the forming position and to thereby fold the blank about said mandrel and bring the longitudinal edges of the folded blank into abutment;

(f) clamping means including clamping bars longitudinally disposed on either side of the abutting longitudinal edges of the folded blank for clamping the abutting longitudinal edges of the folded blank together between said clamping bars for a dwell time sufficient to cool the abutting surfaces and seal the same, and for retracting the clamping bars after the seal has been completed, thereby providing a pouch sealed about said mandrel on all sides thereof except the top of the pouch wherefrom the mandrel may be withdrawn, said clamping means including a mounting frame, slide bars slidably mounted on said mounting frame for movement toward and away from the forming position, said clamping bars being rigidly mounted on one end of said slide bars and a support plate attached to said slide bars at the other end thereof, a spring loaded plunger having a piston member mounted to said support plate and movable within a plunger body, a spring compressible between said piston member and the plunger body, and a stud on said plunger, linkage means connected to said stud of said plunger and to said folded plates for turning the folding plates inwardly and retracting them outwardly in coordination with the movement inwardly and outwardly of said plunger, and a drive cylinder having the drive rod thereof connected to said support plate and responsive to fluid under pressure provided to said drive cylinder to drive said support plate inwardly and outwardly, said spring loaded plunger and said linkage means arranged to provide resilient inward pivoting movement of said folding plates in response to inward movement of said support plate driven by said drive cylinder, whereby said folding plates pivot inwardly in coordination with and leading said clamping bars, and are resiliently held in firm contact with a blank folded about said mandrel when said clamping bars are in contact with the longitudinal edges of the folded blank.

14. Apparatus adapted for forming heat sealed pouches from substantially rectangular paperboard blanks having a front panel, a back panel, a base panel therebetween, triangularly shaped central gusset panels extending outwardly from the base panel, and pairs of triangularly shaped gusset panels extending from the base panel to the edge of the blank between the central gusset panel and the front and back panels respectively, wherein the blanks have a heat activated sealing material on at least the portions of the surfaces thereof which are to be heat sealed, the apparatus comprising:

(a) a mandrel haing opposite flat parallel center sides, a bottom surface, triangularly shaped end surfaces converging from said center sides to longitudinal edges, and upwardy slanted surfaces extending from said bottom surface upwardly and outwardly to said longitudinal edges;

(b) means for driving said mandrel in a reciprocal path of longitudinal travel;

(c) curved forming surfaces disposed on opposite sides of the path of travel of said mandrel, subtantially flat support surfaces extending into said curved forming surfaces, said forming surfaces curving uniformly from said flat support surfaces to a pair of flat lower guide plates extending from the bottom of said curved forming surfaces on either side of the longitudinal path of travel of said mandrel, said flat support surfaces and curved forming surfaces adapted to support a paperboard blank in an initial position with the base panel of the blank underneath the bottom surface of said mandrel in position to be engaged thereby as said mandrel is driven downwardly, said curved forming surfaces adapted to cooperate with said mandrel to fold the paperboard blank longitudinally about said mandrel with the base panel of the blank in contact with the bottom surface of said mandrel and the front and back panels of the blank in contact with the center sides of the mandrel as said mandrel drives the paperboard blank between said curved forming surfaces to a forming position;

(d) means for directing heated air at the blank to activate the heat sealable material on the surfaces of the blank;

(e) opposed pairs of folding plates pivotally mounted on opposite sides of said guide plates for rotation from a position substantially coplanar with the guide plates to an inward position toward said mandrel when in the forming position and to thereby fold the blank about said mandrel and bring the longitudinal edges of the folded blank into abutment;

(f) clamping means including clamping bars longitudinally disposed on either side of the abutting longitudinal edges of the folded blank for clamping the longitudinal edges of the folded blank together between said clamping bars for a dwell time sufficient to cool the abutting surfaces and seal the same, and for retracting the clamping bars after the seal has been completed, thereby providing a pouch sealed about said mandrel on all sides thereof except the top of the pouch wherefrom the mandrel may be withdrawn, said clamping means including a mounting frame, slide bars slidably mounted on said mounting frame for movement toward and away from the forming position, said clamping bars being rigidly mounted on one end of said slide bars and a support plate attached to said slide bars at the other end thereof, a spring loaded plunger having a piston member mounted to said support plate and movable within a plunger body, a spring compressible between said piston member and the plunger body, and a stud on said plunger, linkage means connected to said stud of said plunger and to said folding plates for turning the folding plates inwardly and retracting them outwardly in coodination with the movement inwardly and outwardly of said plunger, and a drive cylinder having the drive rod thereof connected to said support plate and responsive to fluid under pressure provided to said drive cylinder to drive said support plate inwardly and outwardly, said spring loaded plunger and said linkage means arranged to provide resilient inward pivoting movement of said folding plates in response to inward movement of said support plate driven by said drive cylinder, whereby said folding plates pivot inwardly in coordination with and leading said clamping bars, and are resiliently held in firm contact with a blank folded about said mandrel when said clamping bars are in contact with the longitudinal edges of the folded blank.

15. A method of forming pouches, comprising the steps of:

(a) providing a substantially rectangular blank having a heat activated sealing material on at least the portions of the surfaces thereof which are to be heat sealed together;

(b) folding the rectangular blank substantially in half about a central mandrel having openings on the surfaces thereof and walls defining passageways therein which are in communication with the openings;

(c) simultaneously applying vacuum pressure to the passageways of the mandrel when folding the blank about the mandrel to draw the surfaces of the blank to the surfaces of the mandrel;

(d) directing heated air at the interior surfaces of the blank folded about the mandrel to activate the heat sealable material thereof;

(e) folding the sides of the blank about the mandrel to bring the longitudinal side edges of the blank into abutting relationship;

(f) clamping the abutting longitudinal edges of the blank together for a selected dwell time sufficient to allow the heat sealable material to cool and complete the seal along the longitudinal edges to thereby provide a formed pouch;

(g) releasing the sealed longitudinal edges of the formed pouch; and (h) applying air under pressure to the passageways of the mandrel to blow the formed pouch off of the mandrel.

16. Apparatus for forming substantially rectangular paperboard blanks into heat sealed pouches, wherein the blanks have a heat activated sealing material on at least the portions of the surfaces thereof which are to be heat sealed together, comprising:

(a) a mandrel adapted to have a paperboard blank shaped therearound and having opposite flat parallel center sides, a bottom surface, triangularly shaped end surfaces converging from said center sides to longitudinal edges, and upwardly slanted surfaces extending from said bottom surface upwardly and outwardly to said longitudinal edges, openings formed in the opposite parallel center sides and the bottom surface thereof, and walls defining passageways in said mandrel connecting said openings to a port at the top of said mandrel;

(b) means for driving said mandrel in a reciprocal path of longitudinal travel;

(c) curved forming surfaces disposed on opposite sides of the path of travel of said mandrel and adapted to support a paperboard blank in an initial position in the path of travel of said mandrel, said forming surfaces being adapted to cooperate with said mandrel to fold a paperboard blank in the initial position longitudinally about said mandrel as said mandrel drives the paperboard blank between said curved forming surfaces to a forming position;

(d) means for supplying air under vacuum pressure to said port in said mandrel as said mandrel drives the blank to the forming position;

(e) means for directing heated air at the blank to activate the heat sealable material on the surfaces of the blank;

(f) means for folding in the sides of the folded blank on said mandrel in the forming position after activation of the heat sealable material on the blank to bring the longitudinal edges of the folded blank into abutting relationship;

(g) clamping means including clamping bars disposed on either side of the abutting longitudinal edges of the folded blank for clamping the abutting longitudinal edges of the folded blank together between said clamping bars for a dwell time sufficient to cool the abutting surfaces and seal the same, and for retracting the clamping bars after the seal has been completed, thereby providing a pouch sealed about said mandrel on all sides thereof except the top of the pouch wherefrom the mandrel may be withdrawn; and (h) means for supplying air under pressure to said port in said mandrel when the seal between the longitudinal edges of the blank has been completed to thereby force the formed pouch away from the mandrel by the pressure of air in the pouch.

17. Apparatus adapted for forming heat sealed pouches from substantially rectangular paperboard blanks having a front panel, a back panel, a base panel therebetween, triangularly shaped central gusset panels extending outwardly from the base panel, and pairs of triangularly shaped gusset panels extending from the base panel to the edge of the blank between the central gusset panel and the front and back panels respectively, wherein the blanks have a heat activated sealing material on at least the portions of the surfaces thereof which are to be heat sealed, the apparatus comprising:

(a) a mandrel having opposite flat parallel center sides, a bottom surface, triangularly shaped end surfaces converging from said center sides to longitudinal edges, and upwardly slanted surfaces extending from said bottom surface upwardly and outwardly to said longitudinal edges, openings in the opposite parallel center sides and the bottom surface thereof, and walls defining passageways in said mandrel connecting said openings to a port at the top of said mandrel;

(b) means for driving said mandrel in a reciprocal path of longitudinal travel;

(c) curved forming surfaces disposed on opposite sides of the path of travel of said mandrel, substantially flat support surfaces extending into said curved forming surfaces, said forming surfaces curving uniformly from said flat support surfaces to a pair of flat lower guide plates extending from the bottom of said curved forming surfaces on either side of the longitudinal path of travel of said mandrel, said flat support surfaces and curved forming surfaces adapted to support a paperboard blank in an initial position with the base panel of the blank underneath the bottom surface of said mandrel in position to be engaged thereby as said mandrel is driven downwardly, said curved forming surfaces adapted to cooperate with said mandrel to fold the paperboard blank longitudinally about said mandrel with the base panel of the blank in contact with the bottom surface of said mandrel and the front and back panels of the blank in contact with the center sides of the mandrel as said mandrel drives the paperboard blank between said curved forming surfaces to a forming position;

(d) means for supplying air under vacuum pressure to said port in said mandrel as said mandrel drives the blank to the forming position;

(e) means for directing heated air at the blank to activate the heat sealable material on the surfaces of the blank;

(f) means for folding in the sides of the folded blank on said mandrel in the forming position after activation of the heat sealable material on the blank to press the front and back panel about said mandrel and into contact with said triangularly shaped end surfaces of said mandrel and to bring the longitudinal edges of the folded blank into abutting relationship;

(g) clamping means including clamping bars disposed on either side of the abutting longitudinal edges of the folded blank for clamping the abutting longitudinal edges of the folded blank together between said clamping bars for a dwell time sufficient to cool the abutting surfaces and seal the same, and for retracting the clamping bars after the seal has been completed, thereby providing a pouch sealed about said mandrel on all sides thereof except the top of the pouch wherefrom the mandrel may be withdrawn; and (h) means for supplying air under pressure to said port in said mandrel when the seal between the longitudinal edges of the blank has been completed to thereby force the formed pouch away from the mandrel by the pressure of air in the pouch.

* * * * *